United States Patent [19]

Harasina

[11] 4,244,288

[45] Jan. 13, 1981

[54] FLYING PRINTER

[75] Inventor: Yasuhito Harasina, Tokyo, Japan

[73] Assignee: Kyodo Insatsu Kabushiki Kaisha, Tokyo, Japan

[21] Appl. No.: 890,152

[22] Filed: Mar. 27, 1978

[30] Foreign Application Priority Data

Mar. 26, 1977 [JP] Japan ..... 52-33884

[51] Int. Cl.[3] ..... B41J 29/08; B41J 9/10; B41J 9/38

[52] U.S. Cl. ..... 101/93.02; 101/93.31; 101/336; 400/154.4; 400/220.1; 400/454; 400/616.3

[58] Field of Search ..... 400/220.1, 154.4, 454, 400/455, 616.3; 101/93.32, 93.33, 93.31, 336

[56] References Cited

U.S. PATENT DOCUMENTS

| | | | |
|---|---|---|---|
| 484,035 | 10/1892 | Maskelyne | 400/454 |
| 771,217 | 9/1904 | Stickney | 400/454 |
| 1,533,392 | 4/1925 | Corcoran | 400/455 |
| 1,785,999 | 12/1930 | Bryce | 101/93.31 |
| 1,900,046 | 3/1933 | Denzer | 400/454 |
| 2,627,807 | 2/1953 | Buhler | 101/93.31 |
| 3,387,081 | 6/1968 | Kleinschmidt | 400/155 |
| 3,528,368 | 9/1970 | Oberholzer | 101/93.31 |
| 3,545,375 | 12/1970 | Costello | 101/93.31 |
| 3,587,456 | 6/1971 | Jaensch | 101/93.31 |
| 3,795,185 | 3/1974 | Shimodaira | 101/93.31 |
| 3,832,942 | 9/1974 | Murayoshi | 101/93.31 |

*Primary Examiner*—Clyde I. Coughenour
*Attorney, Agent, or Firm*—Blum, Kaplan, Friedman, Silberman & Beran

[57] ABSTRACT

A flying printer of reduced size and weight comprises a continuously-rotating ratchet wheel for driving a printing hammer through an interposed trigger lever and a print drum rotating continuously at a speed in a fixed ratio to that of said wheel. A striking face of a tooth on the ratchet-wheel lies in the same plane as the stroke-receiving face of the trigger lever, and said plane passes through the axis of rotation of said ratchet wheel. Further, the trigger lever is pivotally supported on the arm of the printing hammer, and the region of the arm in which the support of said lever is to be disposed is narrowly prescribed for the most effective transfer of energy from said ratchet wheel to said printing hammer.

A paper-feed mechanism is operatively connected with said printing mechanism, the feed of said paper being intermittent while the drum is designed to rotate continuously.

A ribbon-transfer mechanism provides for the utilization of the entire ribbon and includes means for reducing the force necessary to effect reversal of the direction of transfer of said ribbon, as a result of which the driving mechanism for the entire printer can be made substantially lighter than is usually the case, thereby reducing the overall size and weight of the printer.

18 Claims, 22 Drawing Figures

FLYING PRINTER

BACKGROUND OF THE INVENTION

The present invention relates to a small sized printer for use in recording information read out of a small data processing apparatus called a "micro-computor". More particularly, the invention relates to a so-called "flying printer" in which characters arranged on the peripheral face of a continuously rotating print drum are selectively struck by a printing hammer.

A flying printer of this type, in general, comprises a printing mechanism for driving a hammer for selectively striking type face arranged on the peripheral face of a continuously rotating print drum, a paper transfer mechanism for intermittently transferring a paper to be printed between said print drum and a group of hammer means, and a mechanism for imprinting characters on the paper when the type faces on the print drum are struck by said hammer means.

There is known a flying printer in which the printing mechanism utilizes electromagnetic means for printing selected characters on a continuously rotating print drum, a hammer being directly driven by said electromagnetic means to strike the selected printing characters.

There is also known a small sized flying printer in which a hammer rather than being directly driven by electromagnetic means, is driven by mechanical means including a continuously rotating ratchet wheel and a trigger lever which moves when struck by a tooth of said ratchet wheel, whereby the electromagnet may be reduced in the size and made compact.

In such a small sized flying printer, in general, the hammer struck by the trigger lever is moved more rapidly than the trigger lever and it strikes printing characters on the print drum; however, while the hammer is returning to the stand-by position, it may be hit again by the trigger lever before the trigger level returns to a rest position so that double printing may therefore be caused. In order to avoid such double printing, it has been tried to stop the movement of the trigger lever after the trigger lever strikes the hammer. In such a small sized flying printer, however, the force with which the hammer strikes the type face is weak, and there is brought about a disadvantage that a clear copy cannot be obtained in a single printing operation.

It also is known for the trigger lever to be connected to the hammer for avoiding the above-mentioned double printing. However, in a flying printer including such means, the trigger lever is turned when it receives the hammering action from the ratchet of the ratchet wheel, and the hammered portion slips and the trigger lever is removed from the ratchet before the trigger lever receives sufficient energy from the rotating ratchet to effect satisfactory printing. Accordingly, the striking force of the hammer is weakened, and it sometimes happens that when the hammer returns to the stand-by position, it strikes the printing characters again by the force of the reaction thereby causing double printing.

As the paper transfer mechanism of a flying printer, there is known a mechanism in which a pair of tractors comprising a belt having pins to be engaged with perforations in a form printing paper are disposed above and below the printing position and by intermittently driving said tractors, the paper to be printed is intermittently transferred between a continuously rotating print drum and a group of hammers disposed in parallel to each other and opposing the print drum. In this known paper transfer mechanism when the print drum is struck by the hammer, the paper is pulled and moved in the direction of rotation of the print drum during the time while the drum is in contact with the hammer, and if another hammer strikes the print drum during this time, the line of the printed letters is readily disordered and becomes irregular. Accordingly, in order to eliminate the defect, it is necessary to provide a mechanism for pressing the paper only at the moment the hammer strikes the print drum and to control the timing of this paper-pressing operation. Recently the need for a small sized flying printer cooperative with a small sized information-processing apparatus called "mini-computor" or "micro-computor" has become urgent. When the above-mentioned conventional paper transfer mechanism is adopted, it is very difficult to provide a small flying printer meeting such a requirement.

As the mechanism for providing the ink or coloring material to be used in printing on paper, there is known a mechanism in which an ink ribbon wound on a pair of spools is positioned between the print drum and a group of hammers, one spool is intermittently turned at every printing operation to transfer the ribbon and the direction of the transfer of the ribbon is periodically reversed. Further, it is known that when the diameter of the coil of ink ribbon remaining on the spool is reduced to a certain value, this value is detected and the reversal of the transfer direction is effected. In this known mechanism, since the above reversal is effected while some ribbon still remains on the spool, a certain portion of the ribbon is not used, resulting in an economic disadvantage. As the mechanism for moderating this disadvantage, there is known a mechanism in which eyelet disposed on both the ends of the ink ribbon are detected to effect the above reversal. In such a mechanism, the reversing operation is often uncertain, and when the ink ribbon is guided between the print drum and a group of hammers, the ink ribbon may be bent at an acute angle and a considerable tension may be applied to the ribbon, as a result of which the above reversing operation becomes difficult.

SUMMARY OF THE INVENTION

A flying printer includes as principal components a printing drum rotatable at a selected speed, a ratchet wheel for driving printing hammers against the rows of type-face characters on said printing drum, a paper-feed mechanism, a ribbon-feed mechanism which includes means for reversing the direction of transfer of said ribbon, and means for selecting when a specific hammer should be driven toward said printing drum for effecting printing.

In accordance with the present invention the speeds of said printing drum and said ratchet wheel are set in a fixed ratio. The ratio must be such that when the ratchet wheel has n teeth, the ratchet wheel makes 1/n revolution during the time in which the printing drum rotates through an angle corresponding to the pitch distance, namely, the distance between the center lines of successive type-face characters in a row on said printing drum.

A trigger lever is pivotally supported on an arm of each printing hammer, each trigger lever having a stroke-receiving face. For purposes of minimizing wear and ease of manufacture, said striking face and said stroke-receiving face are preferably planar. Furthermore, at the instant when said striking face makes impact with said stroke-receiving face, both faces should lie in a common plane passing through the axis of rotation of said ratchet wheel. Considering a section taken transverse to said axis, an outermost point designated A is defined on said striking face and said point A traces out a circle as it rotates. The "normal line" is then defined as the tangent to this circle taken at the instant of impact between said striking face and said stroke-receiving face. This line is, of course, perpendicular or normal, to said common plane. For most effective transfer of energy from said ratchet wheel to said hammer means while minimizing rebound which can result in double printing, the support point of said trigger lever on the arm of said hammer means preferably lies on the other side of said normal line from said ratchet wheel. Further, the support point of said trigger lever on the arm of said hammer means should be such that a line connecting point A and said support point should make an angle $\theta$ with said normal line where $\theta$ lies between 0° and 2.7°, $\theta$ being taken as positive when said support point is on the opposite side of said normal line from said ratchet wheel.

The paper transfer mechanism includes wheels at each end of the print drum, each wheel having pins in the periphery thereof disposed for engaging perforations in the paper on which printing is to be effected. The pins serve to move the paper in intermittent fashion with high precision. Arcuate members serve to guide the paper to and around the print drum and then serve to feed the paper in folded form into a receptacle.

The ribbon-transfer mechanism includes two spools, one spool serving as the feed spool and the other as the receiving spool until the ribbon is fully unwound from the feed spool, only the receiving spool being driven by a ratchet and pawl mechanism. When the ribbon has been fully unwound from the feed spool, an eyelet mounted on the ribbon adjacent to the end thereof is trapped by a slot in a reversing lever attached to the feed spool. The reversing lever carries a pivoted reversing ratchet which engages a reciprocating feed lever carrying a pair of feed pawls for driving said spools. In a given orientation, said feed lever can engage and drive only one of said spools, namely said receiving spool. Engagement of said reversing ratchet with said feed lever terminates the engagement of said feed lever with the spool which was previously the receiving spool and initiates engagment of a pawl on said feed lever with the spool which was previously the feed spool and which now becomes the receiving spool, thereby effecting reversal in the direction of transfer of the ink ribbon.

It is therefore a primary object of the present invention to provide an improved small sized flying printer.

Another object of the present invention is to provide a small sized flying printer in which sufficient energy is imparted to the hammers so that several copies can be obtained by one printing operation.

Still another object of the present invention is to provide a small sized flying printer in which double printing can be effectively prevented.

A further object of the present invention is to provide a form-printing paper-transfer mechanism adapted to a small sized flying printer.

An important object of the present invention is to provide a paper-transfer mechanism in a flying printer, in which disorder of printed letters can be prevented by a simple structure.

A significant object of the present invention is to provide an ink ribbon transfer mechanism in a flying printer, in which the reversal of the ribbon transfer direction can be accomplished assuredly.

Yet another object of the present invention is to provide a small sized flying printer in which the foregoing objects can be attained by a simple and relatively inexpensive structure and assembling and adjustment can be performed very easily.

In accordance with the fundamental aspect of the present invention attaining the foregoing objects, there is provided a flying printer which comprises a printing mechanism including a ratchet wheel having at least one tooth rotatable continuously at a first speed, a print drum continuously rotatable at a second speed, said first and second speeds having a specific ratio, a group of hammer means rotatable from a position for impacting characters on a print drum to a stand-by position, a trigger lever for driving said hammer means, said trigger lever being rotatable into and out of the locus or path of the tooth of the ratchet wheel, and means for selectively rotating said trigger lever into the locus of the tooth of said ratchet wheel; a paper transfer mechanism for intermittently feeding a paper to be printed between said continuously rotating print drum and said group of hammer means for printing characters on the print drum; and a mechanism for imprinting characters on said paper when the printing characters on the print drum are struck by said hammer means; said trigger lever being rotatably supported on said hammer means and the trigger lever supporting point on said hammer means being located on the side opposite to the axis of the ratchet wheel with respect to the normal line of the contact point where the tooth of said ratchet wheel hits on said trigger lever, and the angle $\theta$ formed by said normal line and a line connecting said contact point and said supporting point is in the range of $0° < \theta < 2.7°$, the normal line being the line through said contact point which is perpendicular to the line defined by the contact point and the axis of said ratchet wheel.

In accordance with another aspect of the present invention, there is provided a flying printer having the above characteristics, which further comprises a buffer means having an elastic member for receiving said hammer means as it returns to rest or standby position after impacting a character, said elastic member serving to absorb the force of the reaction of hammering, In accordance with still another aspect of the present invention, there is provided a flying printer having the above characteristics, which further comprises a paper transfer mechanism including a pair of wheels rotatably mounted on the rotation shaft of a print drum and having pins to be engaged with perforations formed in a paper, driving means for intermittently rotating said wheels, first guide means having two arcuate members for guiding said paper to said wheels, second guide means having one arcuate member having a notch allowing passage of the pins of the wheels and engaging the perforations of said paper guided by said first guide means with the pins of said wheels to thereby feed said paper to a printing position by hammer means, and press means for pressing said paper guided by said second guide means against said wheels.

In accordance with a further aspect of the present invention, there is provided a flying printer having the above characteristics, which further comprises an ink ribbon transfer mechanism including a pair of spools on which an ink ribbon is wound, a pair of ink ribbon transfer ratchet wheels each engaged with said spools, guide means for guiding the transferred ink ribbon, a pair of reversal operating levers each disposed rotatably coaxially with said ratchet wheels and each including an arm having means for detecting the time for reversing the transfer direction of said ink ribbon and an arm on which a reversing ratchet for causing the reverse operation is rotatably supported, a feed lever having a reversing arm for receiving the reverse operation signal from the reversing ratchet supported on the arm of said reverse operation lever and an arm including a pair of pawls for rotating said ratchet wheel, driving means for imparting reciprocative movements of said feed lever, and spring means for retracting said reversing ratchet outside the path of the reversing arm of said feed lever.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
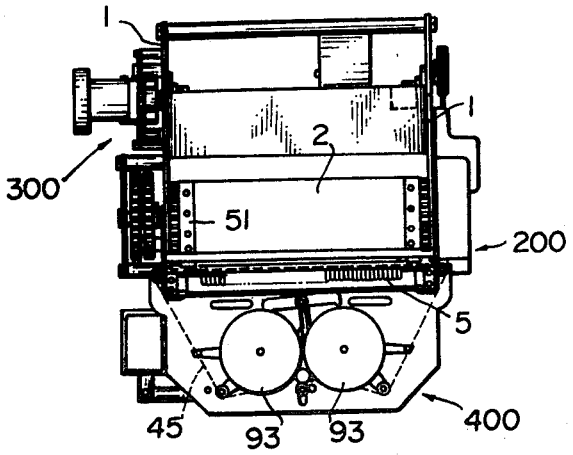
FIG. 1 is a plan view showing the entire structure of the small flying printer of the present invention.
Figure 2:
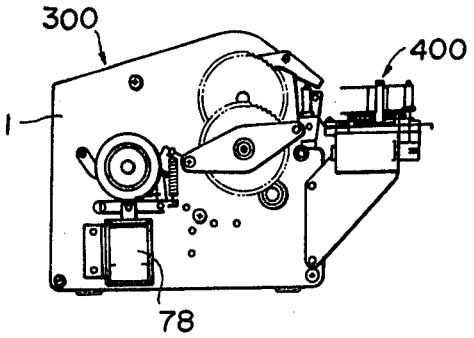
FIG. 2 is a side view of the printer shown in FIG. 1.

FIGS. 1 and 2 illustrate an embodiment of the complete structure of the small sized flying printer of the present invention. This flying printer comprises a printing mechanism 200, a paper transfer mechanism 300 and an ink ribbon transfer mechanism 400, which are mounted on frames 1. In the printing mechanism 200, a tooth 15 (FIG. 3) of a continuously rotating ratchet wheel 14 strikes against a trigger lever 17 connected with a printing or hammer lever 5, and printing is effected by causing the hammer lever 5 to selectively strike one of a number of characters arranged on the circumferential face of a print drum 2 continuously rotating at a speed in a specific ratio to that of the ratchet wheel 14. In the paper transfer mechanism 300, a paper to be printed is intermittently transferred between the print drum 2 and the hammer lever 5 through guide means by a wheel 51 intermittently rotated by an electromagnetic device 78 actuated by application of pulses of current. In the ink ribbon transfer mechanism 400, an ink ribbon 45 wound on a pair of spools 93 is guided between the print drum 2 and a group of hammers, one of the spools 93 is intermittently turned at a predetermined pitch by electromagnetic means at every printing operation to transfer the ribbon 45, and the direction of the transfer of the ribbon is periodically reversed.

Each of the foregoing mechanisms 200, 300 and 400 will now be described in detail.

Figure 3:
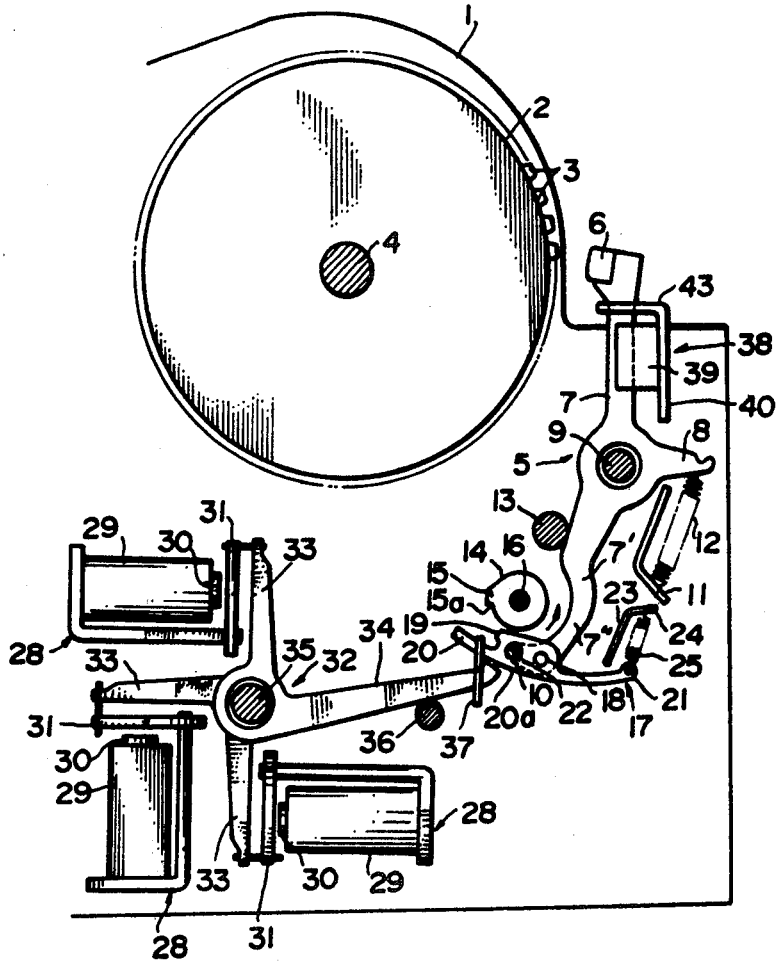
FIG. 3 is a side view illustrating the printing mechanism of said printer.

FIG. 3 illustrates one embodiment of the printing mechanism 200 of the flying printer of the present invention, which is disposed between the frame 1 and a front frame (not shown). Type-face characters 3 to be printed are arranged on the circumferential face of a print drum 2, and the print drum 2 is disposed between the two frames 1 so that the print drum 2 is continuously rotated at a predetermined speed in the direction indicated by an arrow by a rotation shaft 4. In this embodiment, on the print drum 2, 40 characters are aligned with respect to the direction of the rotating shaft (40 columns) and 64 of such lines of printing characters are arranged (64 lines). Instead of the above print drum 2, as is well known, there may be disposed a printing character carrier comprising a belt member which has printing characters arranged thereon, said belt member being mounted on a plurality of shafts or rollers so that it can be rotated.

The hammer lever 5 disposed in the vicinity of the print drum includes arms 7 and 7'. A hammer head 6 for hitting on type-face characters 3 of the print drum 2 is fixed to one end of the arm 7. A trigger lever 17 is rotatably supported on an end of the arm 7' and a side-arm 8 is formed adjacent to the junction of the arms 7 and 7'. A fixed shaft 9 is disposed in parallel to the rotating shaft 4 of the print drum 2 and penetrates the lever 5 substantially at the junction of the arms 7, 7' and 8. Thus, the hammer lever 5 is rotatably supported on this fixed shaft 9. The number of such hammer levers 5 supported in parallel on the fixed shaft 9 corresponds to the number of columns of printing characters arraged in the axial direction of the peripheral face of the print drum 2 (40 columns in this embodiment), and the hammer heads 6 held and fixed on the end portions of the arm 7 of the hammer levers 5 are arranged to oppose the corresponding printing characters. A spring 12 having one end fixed to a support 11 on the frames 1 is connected at its other end to the top end of the side-arm 8 of the hammer lever 5, and the hammer lever 5 is urged by the action of this spring 12 so that the hammer head 6 is normally away from the corresponding printing characters 3, and this position is established by a fixed stop 13. In this manner, such hammer lever 5 is normally located at a non-hammering or stand-by position.

A ratchet wheel 14 comprises one roll having at least one tooth 15 projecting from the peripheral face of the roll, and the ratchet wheel 14 is arranged so that it is rotated by a rotating shaft 16 supported on the frame 1. The ratchet wheel 14 is disposed inside curved portion 7″ of the arm 7′ of the hammer lever 5. The tooth 15 of the ratchet wheel 14 strikes a stroke-receiving surface 19 of the trigger lever 17 in a manner described hereinafter by the term "face contact", and the tooth 15 has a striking surface **15*a* for this striking face contact. The ratchet wheel 14** is continuously rotated at a constant speed in a direction indicated by the arrow by well-known power transmission means (not shown) such as are customarily used for flying printers of this type, said transmission including a direct current or alternating current motor and a belt.

The rotation of the ratchet wheel 14 is transmitted to the print drum 2 through customary gear means so that with every rotation of the ratchet wheel 14, lines of printing characters on the print drum 2 are shifted through a distance of one pitch (a distance corresponding to one line). More specifically, the ratchet wheel 14 and the print drum 2 are arranged so that the print drum 2 is rotated at a predetermined speed ratio to the ratchet wheel 14. In the drawing, only one tooth 15 is shown. In the present invention, of course, a plurality of teeth 15 may be provided. In this case, the rotation speed of the ratchet wheel 14 is determined so that while a plurality of teeth 15 are moved by one pitch, lines of printing characters on the print drum 2 are also moved by one pitch (one line).

The trigger lever 17 mounted on the end portion of the arm 7′ of the hammer lever 5 will now be described in detail.

The trigger lever 17 is pivotally mounted on the end portion of the arm 7′ of the hammer lever 5 for rotation around shaft 18. The stroke-receiving face 19 on the trigger lever 17 is struck by the striking face **15*a* of the tooth 15 of the ratchet wheel 14, making face contact therewith. A relatively small arm 20 extends from that side of the trigger lever 17 which receives the stroke of tooth 15, and a second small arm 21 extends from the other side of said lever. The lever 17 on its side having stroke-receiving face 19 and the arm 20 is constructed to be heavier than the side having arm 21. The peripheral edge 20*a* of the trigger lever 17 defined by the two extended arms 20 and 21 and the above-mentioned portion therebetween has an arcuate shape; the arm 21 of the trigger lever 17 is introduced between teeth of comb-shaped trigger lever guide 23. One end of spring 25 is attached to the outer end portion of the arm 21 and the other end of the spring 25 is fixed to a base portion 24 (FIG. 3) of the trigger lever guide 23**.

The trigger lever 17 is so arranged that by the action of this spring 25, the stroke-receiving face 19 is normally located outside the locus of the tooth 15 of the ratchet wheel 14.

The trigger lever 17 has an opening 22 therethrough, and a small projection 10 formed on the end portion of the arm 7′ of the hammer lever 5 extends into this opening 22 with a certain free clearance. The range of the relative pivotal rotation of the trigger lever 17 about shaft 18 is regulated by the clearance between projection 10 and the wall of the opening 22. It is this clearance which provides for rotation of the trigger lever 17 between a first position in which the stroke-receiving face 19 of the lever 17 can be struck by the striking face **15*a* of the ratchet wheel 14 and a second position outside the path of said striking face 15*a***.

Figure 4:
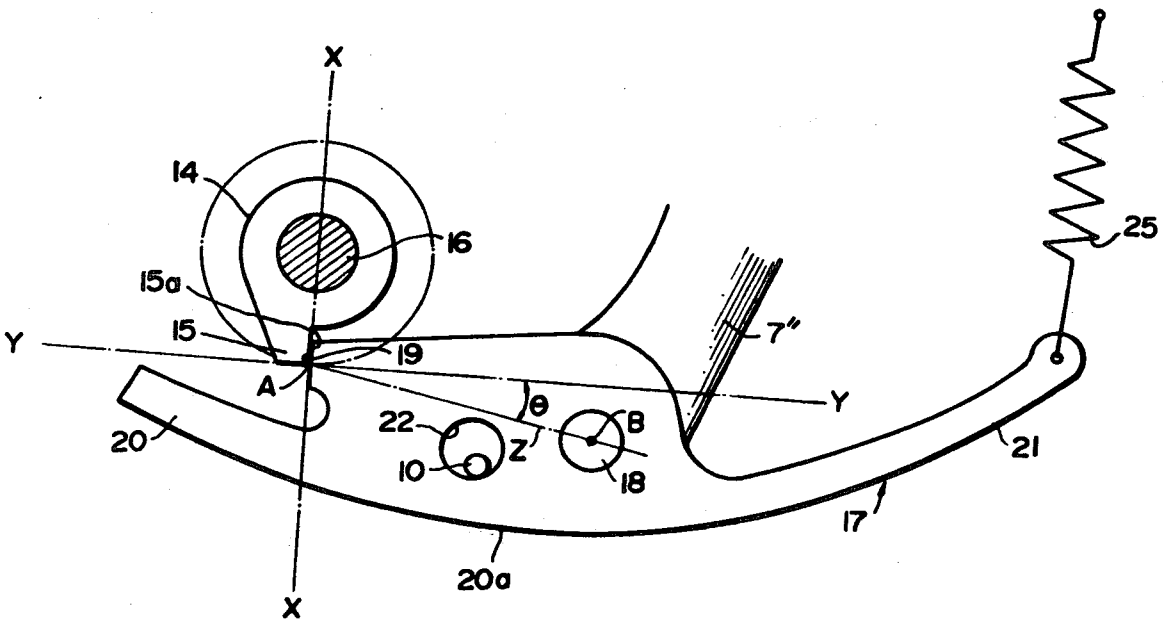
FIG. 4 is a diagram illustrating the point for mounting the triggering lever on the hammer lever in the printing mechanism.

In the present embodiment, the centers of the shaft 9 of the hammer lever 5 and the shaft 16 of the ratchet wheel 14 are so arranged so that when the striking face **15*a* of the ratchet wheel 14 hits the stroke-receiving face 19 of the trigger lever 17, the above-mentioned centers of the shafts 9 and 16 are on the extension line X—X from the contacted faces (see FIG. 4). In another embodiment of the invention (not shown), both the contact faces (15*a* and 19) may be curved. In this case, the above centers are located on the common tangent line of the contact point of the faces 15*a* and 19**.

It is preferred that the trigger lever 17 be mounted on the arm 7′ of the hammer lever 5 so that, as shown in FIG. 4, the angle $\theta$ defined by the tangent line Y—Y and a line Z lie in the range between 0° and 2.7°. Line Y—Y is tangent to the circle traced by point A on the outer edge of the striking face **15*a* and is also perpendicular to the extension line X—X. The line X—X passes through the axis of the ratchet wheel 14 and the point A when the striking face 15*a* makes contact with the stroke-receiving face 19. The line Z passes through point B at the center of shaft 18 and through the point A when the point A is at the intersection of line X—X and Y—Y. The angle $\theta$ is taken as positive when the point B is located on the opposite side to the center of shaft 16** with respect to the line Y—Y.

In the present embodiment, the trigger lever 17 is pivoted on the mounting point B outwardly of the tangent line Y—Y so that the angle $\theta$ is plus 1.4°. In the instant specification, by the term "outwardly of the tangent line Y—Y" is meant "on the side opposite to the axial center of the ratchet wheel 14 with respect to the tangent line Y—Y", and by the term "inwardly of the tangent line" is meant "on the side of the axial center of the ratchet wheel 14 with respect to the tangent line Y—Y".

Referring to FIG. 3 again, reference numeral 28 designates an electromagnetic device which comprises a coil 29 receiving a pulsating current, a pole piece 30 excited by the coil 29 and an armature 31 to be attracted to the pole piece 30. An operating lever 32 connected to the electromagnetic device 28 comprises a first arm 33 connected to the armature 31 and a second arm 34 engaged with the arcuate peripheral edge of the trigger lever 17 so as to rotate the trigger lever 17 against the force of the spring 25 when the electromagnetic device 28 is energized and the first arm 33 of the lever 32 is attracted to said electromagnetic device 28. The operating lever 32 is rotatably supported by a shaft 35 fixed between both side frames 1 and the angle at which the operating lever 32 can be rotated is regulated by a stop bar 36 fixed between both the side frames 1. The second arm 34 of the operating lever 32 extends between teeth of a comb-shaped operating lever guide 37; the arm 20 of the trigger lever 17 also extends between the teeth of the operating lever guide 37 to ensure operative engagement between the second arm 34 of the operating lever 32 and the arcuate peripheral edge of the trigger lever 17. The number of operating levers 32 is equal to that of the trigger levers 17 pivoted on the ends of the arms 7 of the respective hammer levers 5, and these operating levers 32 are arranged on said shaft 35 in parallel to each other at positions corresponding to the positions of the respective trigger levers 17 in the embodiment of FIG. 3. Electromagnetic devices 28 are positioned so as to correspond to the operating levers which are staggered in three directions as shown in FIG. 3 so that they cooperate with the corresponding operating levers 32.

Figure 5A:
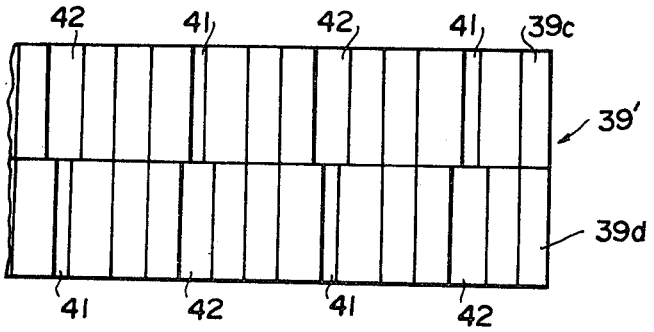
FIG. 5*a* is a front view of the buffer member of the hammer lever in the printing mechanism.
Figure 5B:
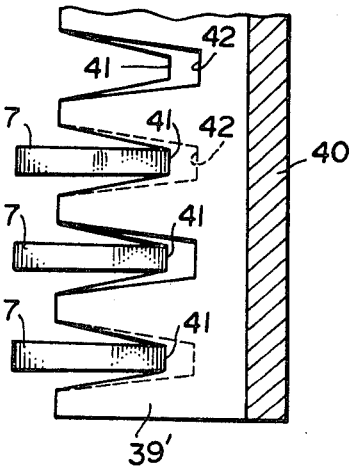
FIG. 5*b* is a plan view of the buffer member.

In FIG. 3 reference numeral 38 designates a buffer member for the arm 7 of the hammer lever 5. The buffer member 38 comprises an elastic member 39 which makes contact with the arm 7 when the hammer lever 5 is at the non-printing position or rest position, and which may be in the form of a plate of natural rubber, synthetic rubber or the like, and a metal plate 40 supporting said buffer member 38. The elastic member 39 of FIGS. 5*a* and 5*b* is not limited to a plate-like elastic member as shown in FIG. 3. For example, there may be used an elastic member 39' as shown in FIG. 5*b*, in which V-shaped grooves are so formed that the arms 7 are enegaged therewith when the hammer lever 5 is in the non-printing position. This elastic member 39' comprises upper and lower two-staged members 39*c* and 39*d* in which shallow V-shaped grooves 41 and deep V-shaped grooves 42 are alternately formed. The members 39*c* and 39*d* are so arranged that the pairs of shallow and deep V-shaped grooves 41 and 42 are combined with each other in the vertical direction, and that the arms 7 of the hammer lever 5 enters the shallow V-shaped groove 41 of one of the upper and lower two-staged members. A comb-shaped guide member 43 (FIG. 3) is integral with and disposed above the metal plate 40 which serves to guide the arm 7 of the hammer lever 5 during movement between the printing and rest positions, whereby the hammer levers 5 are regulated so that the hammer heads 6 strike in precise registry against the characters 3 of the print drum.

Figure 6:
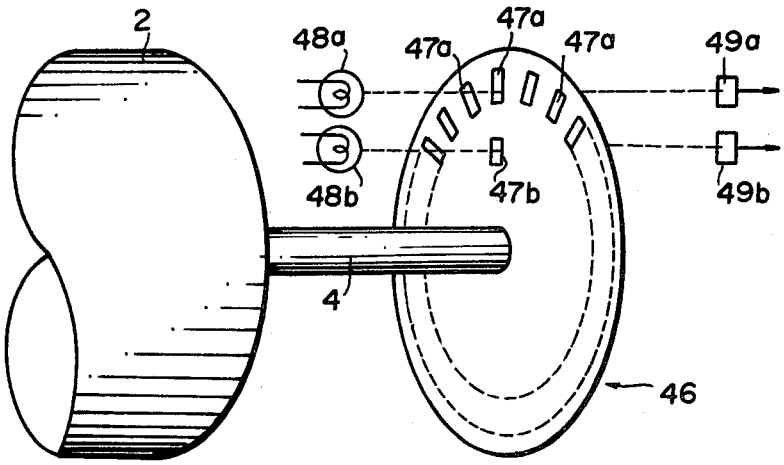
FIG. 6 is a diagram illustrating the timing signal generating device in the printing mechanism.

An embodiment of the printing timing signal generating mechanism in the flying printer of the present invention will now be described by reference to FIG. 6. A timing disc 46 is fixed to the rotary shaft 4 of the print drum 2, and radial slits 47*a* corresponding to rows (lines of the printing characters are arranged along the periphery of the disc 46. Another single optical slit 47*b* is formed in the disc 46. The disc 46 is rotated simultaneously with the print drum 2. On one side of the timing disc 46, there are disposed light sources 48*a* and 48*b* to apply lights to the slits 47*a* and 47*b*, respectively. On the other side, there are disposed phototransistors 49*a* and 49*b* to convert light pulses transmitted through the slits 47*a* and 47*b* into electric signals. This, when the timing disc 46 is rotated synchronously with the rotation of the print drum 2, pulse signals are obtained from the phototransistors 49*a* and 49*b*. The timing signals obtained from the phototransistor 49*a* are counted by a suitable pulse counter, whereby the specific characters at the printing position can be determined. The reset signals obtained from the phototransistor 49*b* are used for resetting to indicate one rotation of the print drum 2.

The operation of selecting a specific character on the print drum to be printed by a specific hammer in the printing mechanism is illustrated hereinbefore by reference to the accompanying drawing, and the structural effect attained by this operation will now be described.

Figure 7:
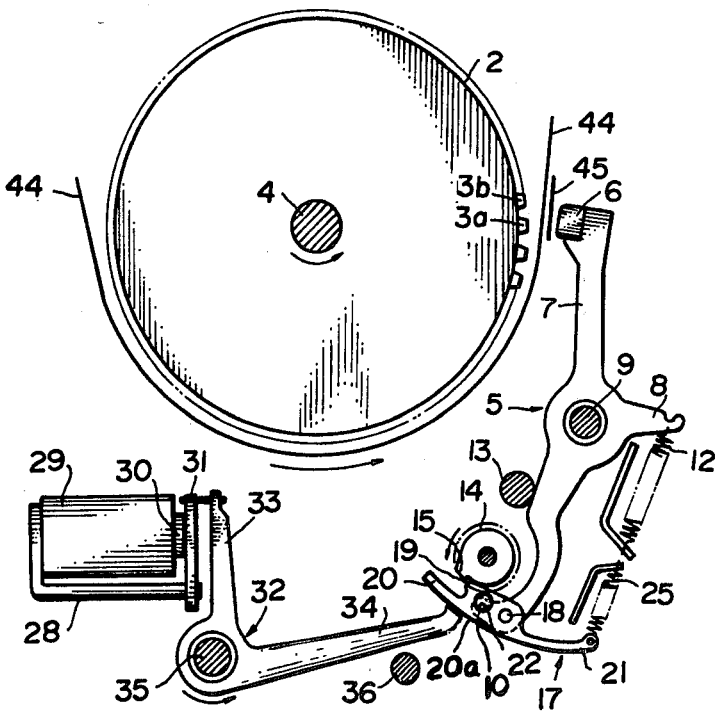
FIGS. 7 and 8 are diagrams illustrating the operations of the printing mechanism.
Figure 8:
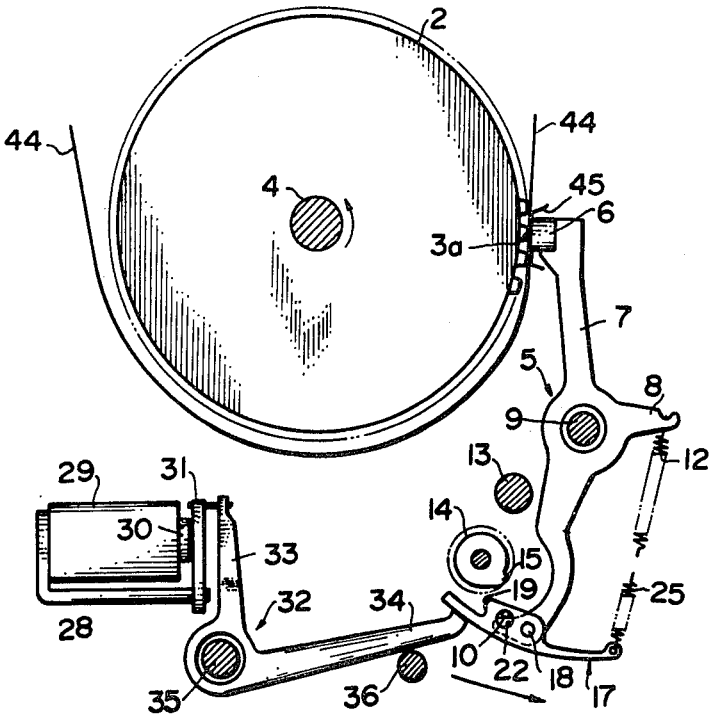

As shown in FIGS. 7 and 8, a paper 44 to be printed is introduced between the print drum 2 and the hammer head 6, and it is intermittently transferred by a paper transfer mechanism described hereinafter. Further, an ink ribbon 45 is held and moved into a space between the print drum 2 and the hammer head 6 by an ink ribbon transfer mechanism described hereinafter. As aforementioned, the rotation of the ratchet wheel 14 is transmitted to the print drum 2 through known gear means, and the print drum 2 and the ratchet wheel 4 are continuously rotated at speeds having a given ratio. In FIG. 7, when one character 3*b* subsequent to a character 3*a* to be printed passes through the printing position, a pulsating current as the printing signal is supplied to the coil 29 of the corresponding electromagnetic device 28 to excite its pole piece 30 to attract the corresponding armature 31. Accordingly, the operating lever 32 having a first arm 33 connected to this armature 31 is turned counterclockwise about the shaft 35, and its second arm 34 rotates the trigger lever 17 about the shaft 18 against the force of the spring 25, whereby the stroke-receiving face 19 of the trigger lever 17 is brought within the locus of the striking face 15*a* of the tooth 15 of the ratchet wheel 14. This position is regulated by the size of the opening 22 in the trigger lever 17 and the projection 10 formed on the arm 7' of the hammer lever 5. Thus, the stroke-receiving face 19 is struck by the striking face 15*a* of the ratchet wheel 14, and as shown in FIG. 8, the trigger lever 17 is shifted in the direction of the arrow, and simultaneously, the hammer lever 5 connected thereto by the shaft 18 is rotated counterclockwise so that the hammer head 6 strikes the character 3*a* through the paper 44 and the ink ribbon 45 to effect printing.

After the hammer head 6 thus strikes the selected character 3*a*, the reaction of this striking operation and the action of the spring 12 reverse the rotation direction of the hammer lever 5 so that it turns clockwise and returns to the original position. As the hammer lever 5 is returned to the non-printing position the coil 29 is de-energized and the operating lever 32 is returned to the original position whereby the arm 34 is brought into contact with the stop 36. The trigger lever 17 pivoted on the arm 7 is turned counterclockwise by the action of the spring 25 and the stroke-receiving face 19 of the trigger lever 17 is retracted outside the sweep or path of tooth 15. Thus, the state shown in FIG. 3 is restored.

When the respective hammers have completed the selection and printing of one line of characters, the paper 44 is then transferred in the direction of an arrow as shown in FIG. 7 by a distance corresponding to the one line of characters by the paper transfer mechanism described hereinafter, and also the ink ribbon is transferred along the row of the hammer heads; the above-mentioned operation is repeated for each printing of a line.

When the printing operation is performed by the above-mentioned structure, it is theoretically preferred that the point B on which the trigger lever 17 is supported on the arm 7' of the hammer lever 5 be located on the above-mentioned tangent line Y—Y, but practically, because of unavoidable production variation, the mounting points B of some trigger levers 17 would be located inwardly of the tangent line Y—Y. In such case, when the trigger lever 17 receives the stroke of the ratchet 15, it turns counterclockwise and this rotation is urged by the force of the spring 25. Accordingly, slip takes place between the stroke-receiving face 19 and the striking face 15*a* of the ratchet 15 at the striking point, and the rotation energy of the ratchet 15 cannot be effectively converted to the energy for driving the hammer lever 5. Further, because of the slip between the striking face 15*a* of the ratchet 15 and the stroke-receiving face 19, both the faces wear rapidly. On the other hand, when the above mounting point B is located outwardly of the tangent line Y—Y, the trigger lever 17 struck by tooth 15 of the ratchet wheel 14 is energized so that it is rotated clockwise, but this rotation is inhibited by the projection 10 on arm 7 of the hammer lever 5 disposed in the opening 22. Further, since as pointed out hereinbefore, the mechanism is so arranged that the axial center of the shaft 9 of the hammer lever 5 and the axial center of the rotary shaft 16 of the ratchet wheel 14 are on the line X—X shown in FIG. 4, the striking force is imposed in the direction of the normal line of the striking face 15*a* and the stroke-receiving face 19 and the movement direction of the faces 15*a* and 19 at the striking point coincide with the direction of said normal line. Under such circumstances there is no slip between the striking face 15*a* of the ratchet 15 and the stroke-receiving face 19 of the trigger lever 17. However, if the angle formed by the line Z connecting the above-mentioned points A and B to each other and the above-mentioned tangent line Y—Y is larger than 2.7°, the energy of rotation in the clockwise direction, which the trigger lever 17 receives by the striking operation of the ratchet 15, becomes excessive and when the hammer lever 5 is returned to the stand-by position after the printing operation, the trigger lever can rotate in the counterclockwise direction, thus bringing stroke-receiving face 19 of the trigger lever 17 into a second engagement with ratchet 15 despite the action of spring 25. As a result, double printing may be brought about and the trigger lever 17 is often damaged.

In the printing mechanism of the flying printer of the present invention, by virtue of the feature that the pivotal point B of the trigger lever 17 is located outwardly of the tangent line Y—Y at the point A and the trigger lever 17 is pivotally mounted on the arm 7' of the hammer lever 5 so that the angle $\theta$ defined by the above tangent line Y—Y and the line Z connecting the point A and point B is in the range of $0° < \theta < 2.7°$, taking the angle $\theta$ as a positive when the point B is located on the side opposite to the axial line of the ratchet wheel 14 with respect to the tangential line Y—Y, occurrence of slips between the ratchets and trigger levers can be positively prevented and the rotational energy of the ratchet wheel can be effectively converted to the energy for driving the hammer levers. Also by virtue of the above characteristic feature, rapid wear and damage of the trigger levers can be prevented and occurrence of double printing can be also completely prevented.

It is construed that prevention of double printing is assured also by the feature that the side including the stroke-receiving face 19 and arm 20 of the trigger lever 17 has a mass larger than the mass of the side including the arm 21 of the trigger lever 17. Alternatively, the moment of the mass of the side including the stroke receiving face 19 may be greater than that of the other side, both moments of the mass being taken relative to the axis of shaft 18, that is, the pivotal axis of the trigger lever 17. In this arrangement, the above side having a larger mass receives a centrifugal force caused by the rotation of the hammer lever 5 and the rotation of the trigger lever 17 in the counterclockwise direction during the rotation of the hammer lever 5 is promoted.

If the trigger lever 17 makes a mechanical effect on the corresponding operating lever 32 at the printing operation, part of the energy to be used by the trigger lever 17 for driving the hammer lever 5 is lost. However, in the printing mechanism of the flying printer of the present invention, by virtue of the feature that the peripheral edge 20*a* of the trigger lever 17 has an arcuate form and the second arm 34 of the operation lever 32 is caused to make sliding contact with this arcuate peripheral edge, the transfer of the energy received by the trigger lever 17 to the operating lever 32 is prevented, and therefore, the striking energy of the ratchet 15 can be effectively and substantially completely converted into energy for driving the hammer lever 5. A high printing pressure can be consequently obtained and 3 to 4 plys of recording papers inclusive of copying papers can be simultaneously printed. This is one of the advantages obtained by the present invention.

In the foregoing embodiment, both the striking face 15*a* and the stroke-receiving face 19 are flat so as to form a flat contact face, and this flat contact face is located on the extension of the line connecting the center of the rotation of the hammer lever 5 and the center of rotation of the ratchet wheel 14 at the moment when the striking is effected. One or both of the striking face 15*a* and the stroke-receiving face 19 may be curved and the contact may be made on a line or point, and an effect similar to the effect attained in the foregoing embodiment can be attained so long as the center of rotation of the hammer lever 5 and the center of the rotation of the ratchet wheel 14 are arranged on the extension of the common contact face at the contacting portion.

Further, even if the extension line of the striking face 15*a* and the stroke-receiving face 19 does not pass through the center of rotation of the ratchet wheel 14 at the time of striking, the above-mentioned effect can similarly be attained so long as the above-mentioned pivotal point B is on the side opposite to the center of rotation of the ratchet wheel 14 with respect to the normal line erected on the contact face at the outermost point A on the striking face 15*a* and the angle $\theta$ defined by this normal line and the line Z is in the range of $0° < \theta < 2.7°$. In this case, it is preferred that the axis of rotation shaft 16 be located on the extension of this common contact face.

By the term "the normal line at the contact point" used in the specification and claims is meant the tangent to the circle traced by outermost point A, said tangent being taken at that point on said circle where striking face 15*a* makes contact with stroke-receiving face 19 of trigger lever 17. As is evident from the geometry of the mechanism, said tangent is normal to line X—X passing through the axis of shaft 16 since line X—X is concurrent with that radius of striking wheel 14 passing through point A when A makes contact with face 19. In the embodiments illustrated in FIGS. 3 and 4, the extension of the contact flat face passes through the axial center of the ratchet wheel, and therefore, the normal line at the contact point is concurrent with the line Y—Y tangent to the circle of the locus of the outermost point A at said point A.

Further, "the common contact plane surface at the contact point" as used in the present specification and in the claims, means the contact plane surface per se in case of the flat face contact.

As aforenoted, after the hammer head 6 has struck the selected character 3*a* to effect printing, the force of the reaction of the hammer head 6 and the force of the spring 12 cause the hammer lever to turn in the clockwise direction and as a result, the hammer returns to the original non-printing position or rest position. If the above buffer member 38 is not provided, since the force of the reaction of striking of the hammer head 6 will then be higher, when the hammer lever 5 returns to the non-printing position, the arm 7 impinges strongly against the guide member 13, and despite the action of the spring 12 the hammer lever 5 rebounds to strike the paper again and an error of double printing is caused. Although in order to eliminate occurrence of this error it was tried to attain a buffer action by attaching an elastic member to the guide bar, it was found that it is impossible to eliminate occurrence of this error by such an arrangement. In the printing mechanism of the flying printer of the present invention, by provision of the above-mentioned plate-like elastic member with which the arm 7 of the hammer lever 5 is allowed to make contact or by forming a V-shaped groove on the elastic member with which the arm 7 of the hammer lever 5 is allowed to make contact so that the arm 7 enters the V-shaped groove while expanding it forcibly, a buffer action can be imparted to the arm 7 and double printing which can hardly be prevented according to the conventional techniques can be assuredly avoided in the present invention. This is another important advantage attained by the present invention.

An embodiment of the paper transfer mechanism 300 will now be described.

Figure 9:
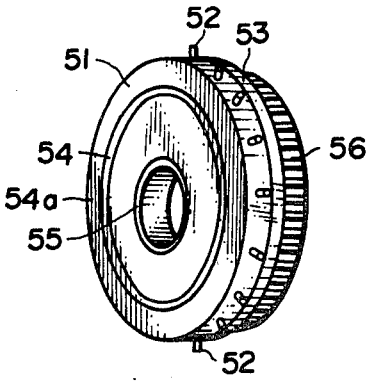
FIG. 9 is a perspective view showing the paper transfer wheel in the paper transfer mechanism.
Figure 10:
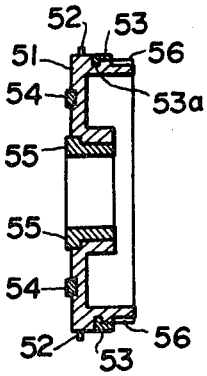
FIG. 10 is a partially cut-off front view of the wheel of FIG. 9.

Referring now to FIGS. 9 and 10, pins 52 to be engaged with uniformly spaced perforations in the paper are provided on a peripheral face of a wheel 51, and a part of the peripheral face of the wheel 51 is covered with an elastic member 53. A thrust washer 54 is fitted in a side wall 54*a* of the wheel 51 and a bearing 55 is attached to the inner circumferential face thereof. Further, a gear 56 is integrally provided on the side portion of the periphery of the wheel 51.

Figure 11:
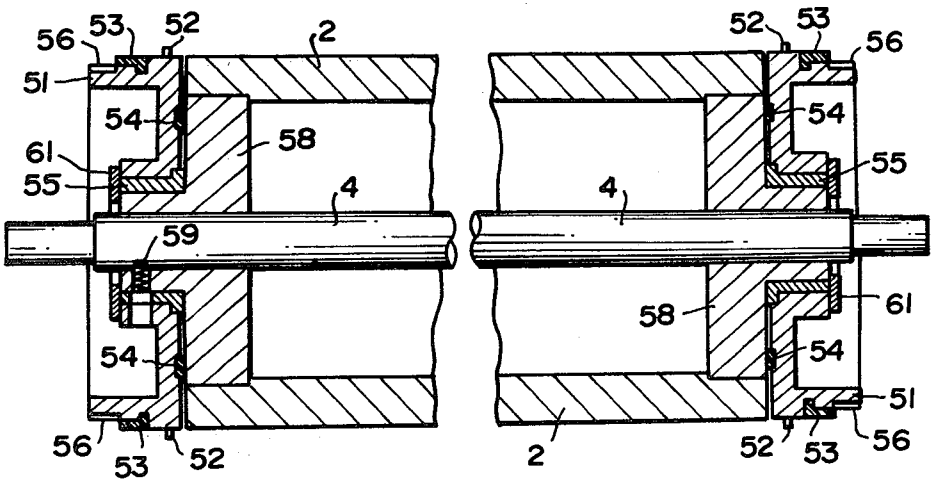
FIG. 11 is a partially cut-out front view illustrating the state of attachment of the wheel of FIG. 9 to the rotation shaft of the print drum.

The wheel 51, pins 52 and gear 56 may preferably be integrally formed from a synthetic resin such as polyacetal resin by injection molding, and the elastic member 53 is in the form of a ring-like member molded from a rubber and is fitted in a concave groove formed in the peripheral face of the wheel 51. The thrust washer 54 is molded from material having a low coefficient of friction such as Teflon, and the bearing 55 is preferably formed from copper type sintered metal impregnated with an oil. As shown in FIG. 11, two wheels 51 are rotatably mounted on the shaft of the print drum 2 by means of the bearing 55, and disposed on both sides of the print drum 2 with the thrust washers 54 disposed between each wheel and the drum. The diameter of the wheels 51 are made slightly larger than that of the print drum 2.

More specifically, flanges 58 are forcedly fixed into both the ends of the print drum 2 and the cylindrical portion of the flanges 58 are fixed to the rotation shaft 4 by means of screws 59 so that they are continuously rotated by this shaft. The wheels 51 are fitted on the cylindrical portion of the flange 58 and anchored by a stop ring 61 so that they are never removed from the cylindrical portion of the flange 58, whereby the wheel 51 can be intermittently rotated by driving means described hereinafter independently of the continuous rotation of the print drum 2.

Figure 12:
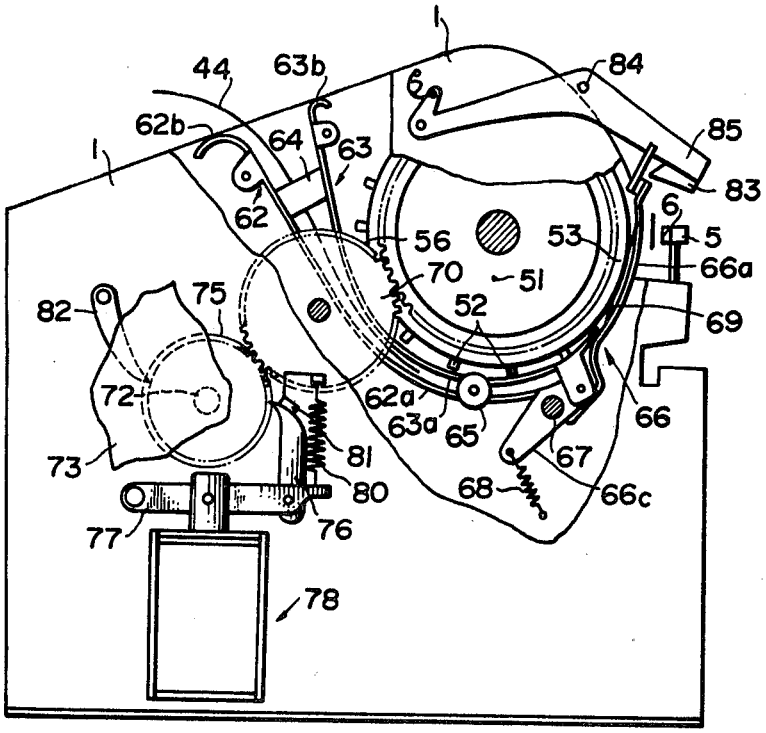
FIG. 12 is a partially cut-out side view illustrating the paper transfer mechanism.
Figure 13:
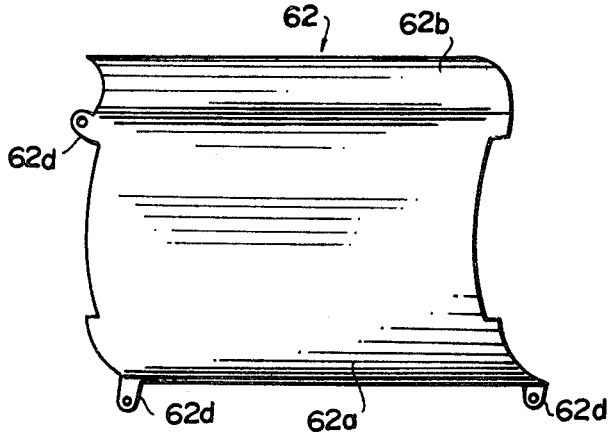
FIGS. 13, 14 and 15 are perspective views illustrating guide members in the paper transfer mechanism.
Figure 14:
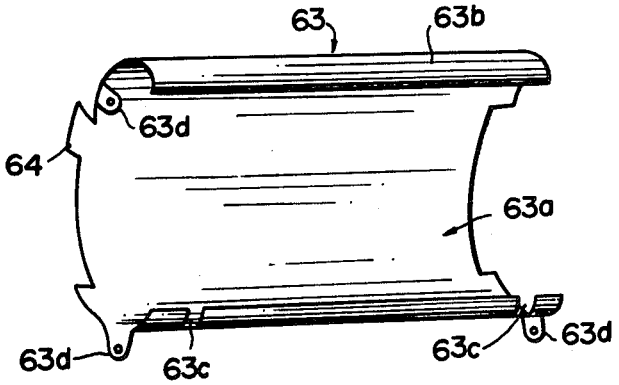

In FIG. 12, guide means for engaging the pins 52 of the wheel 51 with the perforations in the paper include three plate-like members 62, 63 and 66. The guide members 62 and 63 have arcuate (semi-cylindrical) curved portions 62*a* and 63*a*, respectively, as shown in perspective in FIGS. 13 and 14. These curved portions are overlapped in a closely opposed manner to form a paper transfer passage therebetween and small curved portions 62*b* and 63*b* are further formed on the curved portions 62*a* and 63*a* to form a paper-inserting port. A notch 63*c* (FIG. 14) for preventing interference with the pin 52 is formed on each side of the other end of the curved portion 63*a* of the guide member 63. The notched end of the curved portion 63*a* is brought close to the wheel 51 so as to allow the pin 52 to pass through the interior of the notch 63*c* of the guide member 63; the guide members 62 and 63 are fixed to the frames by ear pieces 62*d* and 63*d* formed at both sides of curved portions 62*a* and 63*a* so that the curved portions 62*a* and 63*a* may be held in position to surround the wheel 51 and the print drum 2.

In the paper-inserting port formed by the guide members 62 (FIG. 12) and 63, a pair of bent guide pieces 64 are provided on the guide member 63 at both sides thereof and a rivet-like member 65 is mounted at the position of the frame along the paper transfer passage so that the transfer of the paper is regulated by the head of this member 65 and the above-mentioned guide pieces 64 so as to engage the pins 52 with the perforations in the paper.

Figure 15:
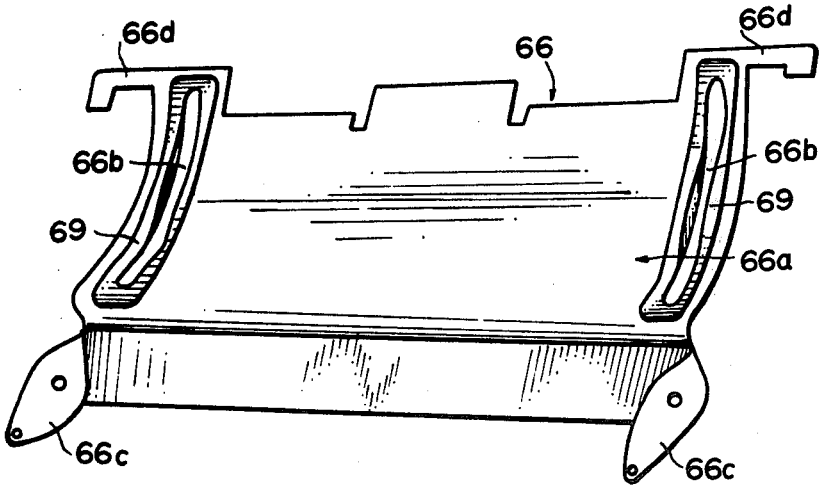

As shown in FIG. 15, the guide member 66 has an arcuate curved portion 66*a*; notch grooves 66*b* allowing passage of the pins 52 are formed at both the sides of the curved portion 66*a*. Tabs 66*c* having a hole are provided on curved portion 66*a*. The guide member 66 is rotatably supported by a shaft 67 (FIG. 12) extending through the holes in the tabs 66*c* and supported on the frame 1. A spring 68 has one end fixed to the end of tab 66*c* so that the guide member 66 is biased toward the wheel 51; pieces 66*d* (FIG. 15) extend upwardly and outwardly from both sides of curved portion 66*a*. These pieces bear against the edge of the frame 1 so as to restrict the above-mentioned rotation.

The pressing means for pressing the paper engaged with the wheel 51 by the above-mentioned guide means against the wheel 51 includes leaf springs 69 (FIGS. 12 and 15). Each leaf spring 69 has a notched portion facing the notched portion 66*b* formed in the curved portion 66*a* of the guide member 66, and the leaf springs 69 are disposed on each side of the curved portion 66*a* so that the notched portions align with the notched portion 66*b*. The leaf springs 69 are spot-welded on the curved portion 66*a*. Accordingly, leaf springs 69 press the paper against the wheel 51 at or slightly before the printing position.

Figure 16:
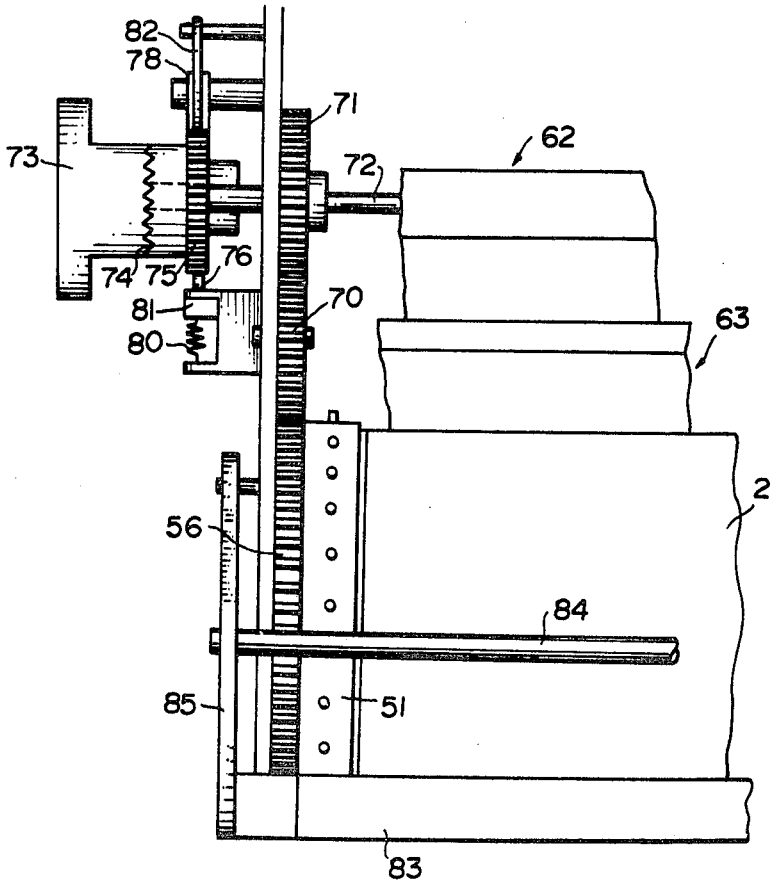
FIG. 16 is a plan view showing the paper transfer driving mechanism.

In FIGS. 12 and 16, the driving means for intermittently rotating the wheel 51 for transferring the paper comprises the above-mentioned gear 56 formed integrally with the wheel 51, an intermediate gear 70 engaged with the gear 56 and supported on the inside of the frame 1, a gear 71 (FIG. 16) engaged with the intermediate gear 70 and fixed to a shaft 72 mounted on the frame 1, a knob 73 disposed outwardly of the frame 1 and rotating with the shaft 72, a ratchet wheel 75 engaged with the knob 73 through a clutch 74, an operation lever 77 (FIG. 12) of an electromagnetic device 78 having a pawl 76 engaged with the ratchet wheel 75, a spring 80 for biasing the operation lever 77 to rotate the ratchet wheel 75 by the pawl 76, a stopper 81 for stopping the pawl 76 against the force of the spring 80 and a pawl 82 for preventing reverse rotation of the ratchet wheel 75. The driving means is actuated when a pulsating current is applied to the electromagnetic device 78.

In FIGS. 12 and 16, the means for treating the printed paper 44 includes a cutting auxiliary plate 83 and a guide bar 84. The cutting auxiliary plate 83 and the guide bar 84 are fixed to a pair of anchoring members 85 having one end rotatably supported on the frame 1. The cutting auxiliary plate 83 is disposed in the vicinity of the printing position, and the guide bar 84 is disposed above the print drum 2.

The paper to be printed is folded along a perforation line and is stored in a vessel separate from the printer of the present invention. When the printing operation is to be performed, the paper is taken out of the vessel and one end of the paper is manually inserted into the port between the curved end portions 62*b* and 63*b* of the guide members 62 and 63; the paper is guided through the passage defined by the arcuate curved portions 62*a* and 63*a*. The transfer position of the paper 44 is regulated by a pair of the guide pieces 64 on the guide member 63 and the rivet member 65 attached to the frame 1 along the paper transfer passage so that the perforations of the paper are engaged with the pins 52 of the wheel 51. The paper is guided by the curved portions 63*a* and 66*a* of the guide members 63 and 66, and since the notched portions 63*c* and 66*b* are formed in the guide members 63 and 66 so that the pins 52 can be extended through the notched portions 63*c* and 66*b*, the pins 52 can be engaged with the perforations in the paper 44 through these notched portions 63*c* and 66*b* so as to advance the paper. If the leading end of the paper 44 makes contact with the pin 52, the paper 44 cannot be advanced. Accordingly, in the paper transfer mechanism of the present invention, the guide member 66 is constructed to rotate about the shaft 67, and therefore the pins 52 can be temporarily disengaged manually from the notched groove 66*b* at the beginning of operation so that the leading end of the paper 44 rides over the pin 52 so as to engage the pin 52 with one of the perforations in the paper for advancing the paper. Then, the knob 73 is temporarily disengaged from the ratchet wheel 75 and by manually rotating the knob 73, the shaft 72 is turned and the gear 56, integrated with the wheel 51, is rotated through the gear 71 fixed to the shaft 72 and the intermediate gear 70, whereby the pins 52 of the wheel 51 can be engaged with the perforations of the paper 44. The knob 73 is further operated to rotate the wheel 51, and the paper 44 is transferred by the action of the pins 52 whereby the paper 44 can be set at the printing position. By this setting operation, wasteful consumption of the paper can be effectively prevented. In this case, since the paper 44 to be printed is transferred in a curved state to the printing position by the guide members 62, 63 and 66 and the wheel 51, wavy curving of the paper at the printing position is prevented. Also, since the diameter of the wheel 51 is slightly larger than that of the print drum 2, the paper is prevented from making contact with the continuously rotating print drum 2 and hence, generation of noises can be prevented. Since the paper 44 set at the printing position is pressed against the wheel 51 covered with the elastic member 53 having a high coefficient of friction by the pressing means including the leaf spring 69, even if the hammer head 6 on the hammer lever 5 is operated to strike the continuously rotating print drum 2 through the ink ribbon 45 and the paper 44, the paper 44 is hardly moved and as a result, disorder of printed letters on the paper can be effectively prevented.

In general, while the print drum 2 makes one rotation, the hammer levers 5 arranged in parallel to confront the print drum 2 are operated to effect printing of one line. On completion of printing of a line, the pulsating current is applied as the paper transfer-instructing signal to the electromagnetic device 78, as a result of which the operating lever 77 retracts the pawl 76 and elongates the spring 80. When application of the pulsating current is stopped, the spring 80 restores the operating lever 77 and the pawl 76 connected thereto to rest position, thereby rotating the ratchet wheel 75 through an angle corresponding to the pitch distance of said wheel. Since the ratchet wheel 75 is engaged with the knob 73, shaft 72 is rotated by the ratchet wheel 75 and the gear 56, which is integrated with wheel 51, is rotated through the gear 71 fixed to the shaft 72 and the intermediate gear 70, whereby the paper 44 is moved by the pins 52 engaged with the perforations in said paper and a form on the paper to be subsequently printed is set at the printing position.

In this embodiment, if the coefficient of slip friction between the paper 44 and wheel 51 should be higher than the coefficient of the slip friction between the paper 44 and the leaf spring 69, transfer of the paper 44 is not prevented by the rotation of the wheel 51. Accordingly, so far as the above relation is maintained, the pressing means is not limited to the above leaf spring 69 and a ring composed of elastic material such as rubber and rotatably supported on the shaft may be used instead of the leaf spring 69.

When the printed paper 44 is manually pulled against the edge of the cutting auxiliary plate 83 in a lateral manner, it can easily be cut along the perforation line. Since the paper 44 is kept engaged with the wheel 51 by the engagement of the pins 52 with the perforations in the paper and the paper is pressed against the wheel 51 by the pressing means, this paper cutting operation has no adverse influence on the subsequent printing operation. Accordingly, the printed paper 44 can be provided for use immediately after completion of the printing operation. This is another advantage attained by the present invention. In the case where the printed paper 44 need not be cut immediately after the printing operation, the printed paper 44 is guided in a direction opposite to the direction of advance by means of guide bar 84 and is fed in folded state into another vessel (not shown).

As will be apparent from the foregoing illustration, in the paper transfer mechanism of the present invention, by virtue of the feature that the wheel 51 having pins 52 for transferring the paper 44 is rotatably mounted on the shaft of the print drum 2 and that the guide members 62, 63 and 66, for engaging the paper with the wheel 51, are formed to have an arcuate shape and are arranged to surround the wheel 51 and the print drum 2, the structure of the flying printer can be simplified and the size of the flying printer can be decreased.

An embodiment of the ink ribbon transfer mechanism 400 will now be described.

Figure 17:
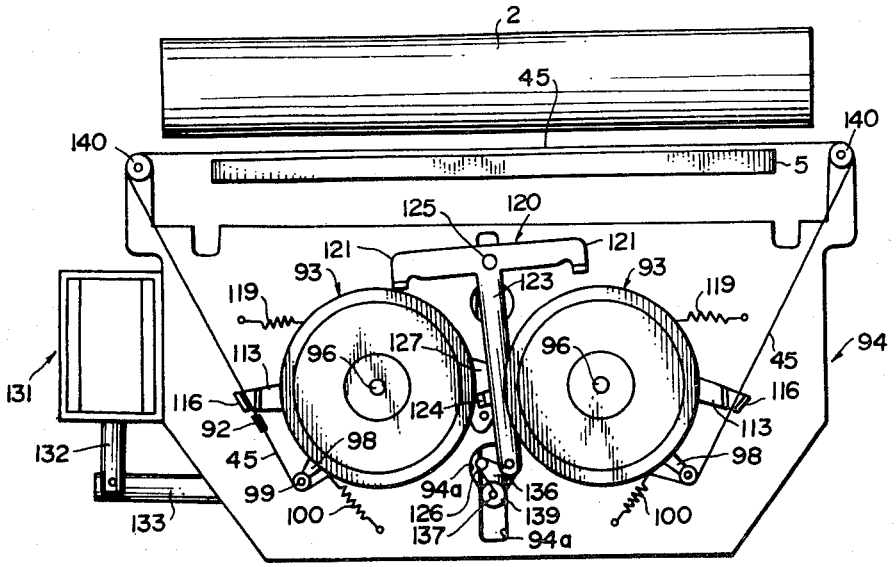
FIG. 17 is a plan view showing the ink ribbon transfer mechanism.
Figure 18:
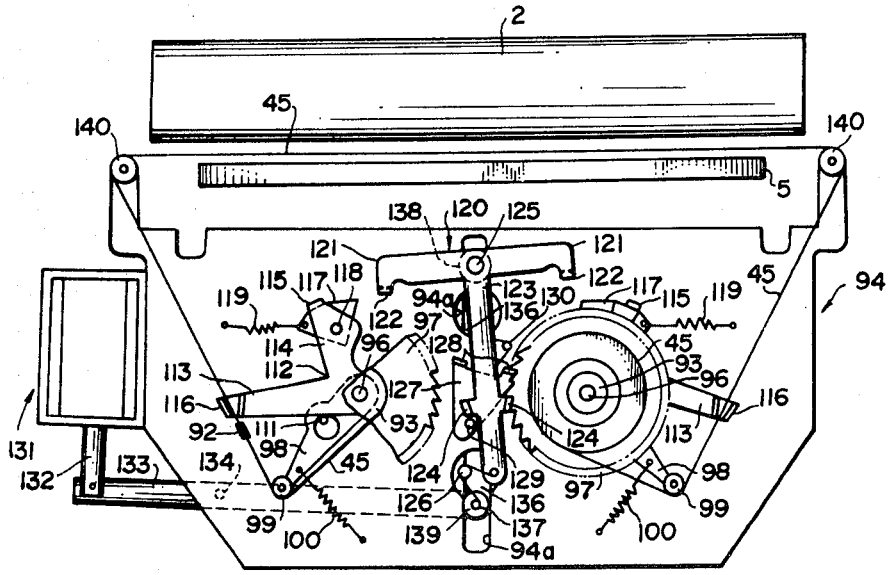
FIG. 18 is a partially cut-out plan view illustrating the ink ribbon transfer mechanism.
Figure 19:
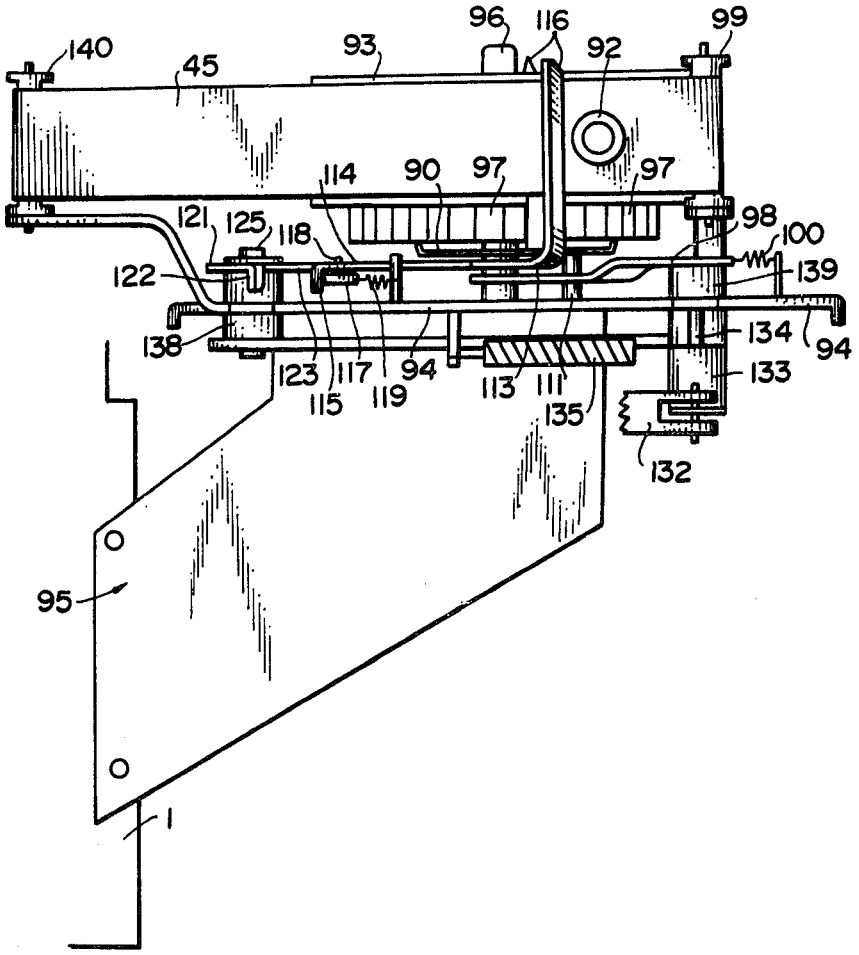
FIG. 19 is a side view illustrating the ink ribbon transfer mechanism.

Referring to FIGS. 17 and 18, eyelets 92 are provided at both ends of the ink ribbon 45, and the ends of ink ribbon 45 are connected to cores of a pair of spools 93. The ink ribbon 45 is guided from one spool through the passage between the print drum 2 and the group of hammer levers 5 and is wound to the other spool 93. In the drawing, the ink ribbon 45 is wound on the right-hand spool 93 and the left-hand eyelet 92 is exposed. Side plates 95 (FIG. 19) are attached to a base plate 94 on both its sides and the base plate 94 is fixed to the frames 1 of the flying printed through the side plates 95. In FIG. 19, one of the side plates is omitted. A pair of left-hand and right-hand shafts 95 (FIGS. 17 and 18) are mounted on the base plate 94, and a pair of ratchet wheels 97 are rotatably supported on the shafts 96. The ratchet wheels 97 are engaged with the spools 93 on the shafts 96 to rotate the spools 93, whereby the ink ribbon 45 is transferred from one spool 93 to the other spool 93. In order to prevent slackening of the ink ribbon 45 as the result of accelerated rotation of one of said ratchet wheels 97 relative to the other, a leaf spring 90 having a hole (FIG. 19) is mounted on the shaft 96 of the ratchet wheel 97 so as to prevent accelerated rotation of the ratchet wheel 97. In FIGS. 17 and 18, guide levers 98 for guiding the ink ribbon 45 are rotatably supported on the shafts 96, and guide rollers 99 are mounted on the outer ends of the guide levers 98. Also, springs 100 each have one end fixed to the base plate 94 and have the other end connected to the outer ends of the guide levers 98. In FIG. 18, the left-hand guide lever is urged in the counterclockwise direction and the right-hand lever is urged in the clockwise direction by the spring 100, and such rotation is limited by stops 111 mounted on the base plate 94 (only one of said stops being shown). Reversing levers 112 are rotatably supported on the shafts 96 to reverse the ink ribbon transfer direction; each lever 112 comprises a first arm 113 for detecting the eyelets 92 and a second arm 114 for causing the reversing operation. A plate member 116 having a slit allowing passage of the ink ribbon 45 therethrough but barring passage of the eyelets 92 is provided on the outer end portion of the first arm 113 as means for detecting the reversing time. The engagement of the eyelet 92 with this plate member 116 shows that the ribbon is essentially completely unwound from the left spool 93. An inwardly bent piece 115 is mounted on the outer end portion of each second arm 114 and a reversing ratchet 117 is supported on the outer end portion of the second arm 114 so that the ratchet 117 can be rotated on a shaft 118. A spring 119 has one end fixed to the base plate 94 and has the other end connected to that end of the ratchet 117 which does not engage a reversing arm 121 of a feed lever 120 described hereinafter. Against the force of springs 119, the left-hand ratchet 117 is rotated in the counterclockwise direction and the right-hand ratchet 117 is rotated in the clockwise direction as shown in FIG. 18 and as described hereinafter, but they are prevented from rotating in the reverse directions by the bent pieces 115 acting as stops. Further, the left-hand reversing lever 112 is biased in the counterclockwise direction and the right-hand reversing lever 112 is biased in the clockwise direction by the springs 119, but their rotations are limited by the stop 111.

A T-shaped feed lever 120 for selectively rotating one of the ratchet wheels 97 comprises a pair of reversing arms 121 extending rightward and leftward and an arm 123 extending downwardly. The feed lever 120 is rotatably connected at the junction of these arms to one end of a driving arm 136 described hereinafter, said driving arm 136 being disposed underneath the base plate 94. The connection is made by means of a shaft 125 extending through a slot **94*a* in the base plate 94. An inwardly bent piece 122 is downwardly provided at the end of each reversing arm 121 so that the bent piece 122 may engage with one or the other of the reversing ratchets 117. Outwardly curved feed pawls 124 project from both sides of the arm 123. One end of the feed pawl 124 engages one of the ratchet wheels 97 through the effect of a loop spring 126 having one end fixed to a shaft 137 described hereinafter so that one of the ratchet wheels 97 is rotated by the reciprocation of the feed lever 120** in the upward or downward direction.

A reference numeral 127 indicates a member for preventing reverse rotation of the ratchet wheels 97, said member 129 having outwardly projecting pawls 128. The member 127 is supported rotatably on a shaft 129 mounted on the base plate 94 and engages one of the ratchet wheels 97 through the effect of loop spring 130 having one end fixed to the base plate 94, and this member 127 is switched so that it engages first one and then the other of ratchet wheels 97 according to the rotation, around the shaft 125, of the arm 123 of the feed lever 120 located between the pawls 128.

The driving means for reciprocating the feed lever 120 in the upward or downward direction so as to rotate the ratchet wheels 97 comprises an electromagnetic device 131 mounted on the side plate (FIG. 19), a driving lever 133 (FIG. 18) connected to magnetic core 132 of the electromagnetic device 131, said driving lever being rotatably supported on a shaft 134 disposed on the back face of the base plate 94, a spring 135 (FIG. 19) having one end connected to the back face of the base plate 94 and the other end attached to an arm portion on the right side of the shaft 134 of the driving lever 133, and a driving arm 136 having one end connected to the driving lever 133 through a shaft 137 extending through the slot **94*a* in the base plate 94 and the other end connected to the feed lever 120 through the shaft 125. Plastic rings 138 and 139 (FIG. 19) having guide grooves formed in the side face in the circumferential direction thereof are fitted to the shafts 125 and 137, respectively, and these guide grooves are engaged with the slots 94*a* of the base plate 94 to guide the driving arm 136 and regulate the movement thereof. Rollers 140 are disposed to guide the ink ribbon 45 to the printing position between the hammers and the print drum 2**.

When the ribbon transfer mechanism of the present invention is used in the vertical state, the top of the shaft 96 may be threaded and a cap member having a threaded inner face may be engaged with said top of the shaft 96, whereby separation of the spool 93 from the drive mechanism is prevented.

The ribbon transfer operation of the above-mentioned ink ribbon ribbon transfer mechanism will now be described.

When a current pulse as a ribbon transfer instructing signal is applied to the electromagnetic device 131, the magnetic core 132 is attracted and the driving lever 133 is turned in the clockwise direction, whereby the spring 135 is elongated and the feed lever 120 is moved downwardly in FIG. 18 through the driving arm 136 connected to the driving lever 133. When application of the current is stopped, the driving lever 133 is turned in the counterclockwise direction by the restoring force of the spring 135 and the feed lever 120 is upwardly moved to the original position shown in FIG. 18 through the driving arm 136 connected to the driving lever 133. Thus, the feed pawl 124 mounted on the arm 123 extending below the feed lever 120 rotates the ratchet wheel 97, and in turn, the spool 93 engaged with this ratchet wheel 97 is turned to wind the ink ribbon 45 thereon.

In the foregoing manner, the ratchet wheel 97 is intermittently turned every time the printing operation is performed, and the ink ribbon is thus transferred at a predetermined pitch.

The operation of reversing the ink ribbon transfer direction will now be described.

Figure 20:
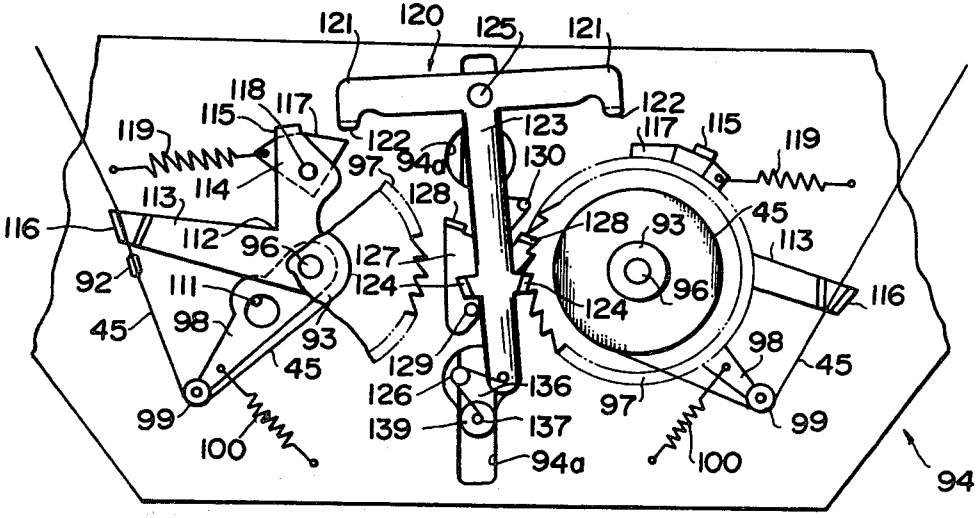
FIGS. 20 and 21 are partially cut-out plan views illustrating the operation of the ink ribbon transfer mechanism.
Figure 21:
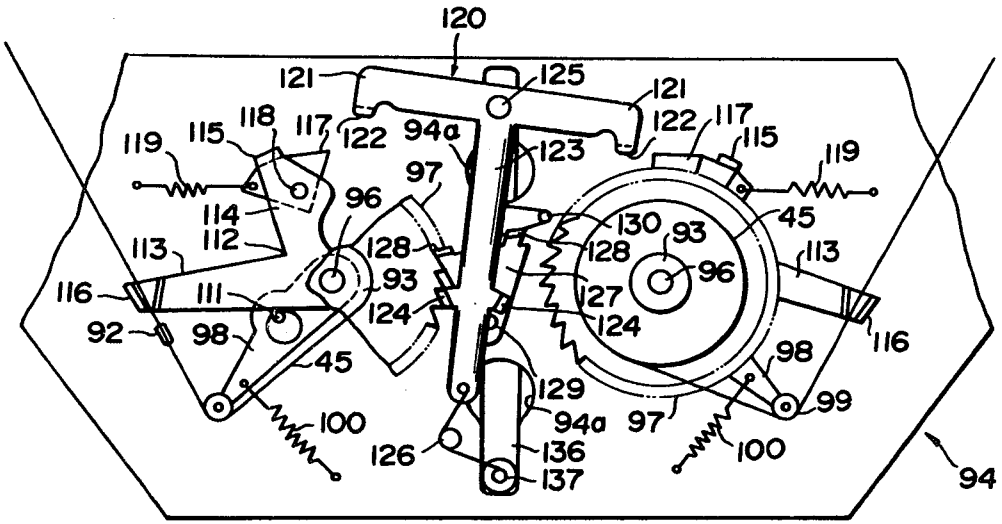

In FIG. 18, there is illustrated the state in which the ink ribbon 45 has been fully wound onto the right spool 93 and the eyelet 92 disposed at the left end of the ink ribbon 45 is about to make contact with the plate 116, thus functioning as the reversing-time detecting means on the first arm 113 of the reversing lever 112. In this state, if the ink ribbon 45 is further wound on the right spool 93, the eyelet 92 is caused to engage with the left plate member 116, whereby the reversing lever 112 is turned in the clockwise direction and the outer end of the reversing ratchet 117 mounted on the second arm 114 is introduced into the path of bent piece 122 on the reversing arm 121 of the feed lever 120 (see FIG. 20). When a ribbon feed signal in the form of a current pulse is then applied to the electromagnetic device 131 the feed lever 120 is moved downwardly as described hereinbefore, and the bent piece 122 engages with the top end portion of the reversing ratchet 117. Since the clockwise rotation of the reversing ratchet 117 is prevented by the bent piece 115 formed on the second arm 114 of the reversing lever 112, the feed lever 120 is rotated in clockwise direction around the shaft 125 and the left-hand feed pawl 124 formed on the arm 123 of the lever 120 engages the left-hand ratchet wheel 97. Simultaneously, also, the pawl 128 of the reverse rotation-preventing member 127 engages left-hand ratchet wheel 97 (FIG. 21). When application of the current pulse is then stopped, the feed lever 120 is moved upwardly in FIG. 21 by the action of the spring 135 as noted hereinbefore, and the left ratchet wheel 97 is rotated by the pawl 124 on the left-hand side of the arm 123, whereby the left-hand spool 93 engaged with this ratchet wheel 97 is caused to wind the ribbon 45 and the transfer direction is thus reversed.

In practice, when the eyelet 92 makes contact with the plate member 116 during the transfer of the ink ribbon 45, if the rotation angle of the reversing lever 112 is small, it sometimes happens that the top end of the reversing ratchet 117 supported on the second arm 114 of the reversing lever 112 does not enter the path of the reversing arm 121 of the feed lever 120. In this condition, when the next ribbon feed signal is applied and the feed lever 120 is moved downwardly, since the bent piece 122 of the reversing arm 121 is not engaged with the reversing ratchet 117, the transfer direction of the ink ribbon 45 will not be reversed. Accordingly, when the above signal is stopped and the feed lever 120 is moved upwardly, the ink ribbon 45 will be further wound on the right spool 93. As a result, the left reversing lever 112 will be further turned in the clockwise direction thereby causing a malfunction in which the reversing ratchet 117 engages the side face of the bent piece 122 of the reversing arm 121 of the feed lever 120. The advantage accruing from reversing ratchet 117 can be readily seen from consideration of a structure locking such a ratchet. Suppose that a projection were formed on the end portion of the second arm 114 of the reversing lever 112, the function of this projection being to engage the bent piece 122 on the reversing arm 121 of the feed lever 120 when eyelet 92 causes rotation of said reversing arm. Then, should an abnormal engagement such as above-mentioned be caused, the lever 112 would be forcibly turned in the reverse direction, namely in the counterclockwise direction, by the reversing arm 121 of the feed lever 120. The projection formed on the second arm 114 would then be taken out again from the path of the reversing arm 121 of the feed lever 120 and the abnormal engagement between the reversing lever and the feed lever would be repeated. Thus, the ribbon transfer direction would not be reversed.

In the ink ribbon transfer mechanism of the present invention, since the reversing ratchet 117 is pivotally supported on the second arm 114 of the reversing lever 112 so that it can be rotated around the shaft 118, when an abnormal engagement such as above-mentioned takes place, reverse rotation of the reversing lever 112 is not caused and only the reversing ratchet 117 is turned in the counterclockwise direction. Also, the reversing ratchet 117 is released from the above abnormal engagement when the current pulse is terminated. Then, against the restoring force of the spring 119, the end portion of the reversing ratchet 117 can be introduced into the path of the reversing arm 121 of the feed lever 120 at the next current pulse, and the transfer direction of the ink ribbon 45 can be reversed assuredly.

If the above-mentioned guide lever 98 rotatably supported on the shaft 96 is not provided, there is brought about the following disadvantage. Namely, when the direction of transfer of the ribbon 45 is reversed, since the reversing lever 112 is turned against the force of the spring 119, a high tension is imposed on the ink ribbon 45 and a greater force is required for rotation of the ratchet wheel 97 engaged with the spool 93. Especially when the above-mentioned abnormal engagement takes place, it would not be possible for the reversing arm 121 of the feed lever 120 driving the above ratchet wheel 97 to turn the reversing ratchet 117 unless a very strong electromagnetic device were used. In contrast, when the guide levers 98 are rotatably supported on the shafts 96 as in the foregoing embodiment, and the direction of transfer of the ink ribbon is to be reversed from the condition as shown in FIG. 20 to that shown in FIG. 21, if the reversing lever 112 is rotated against the spring 119 and an excessive tension is going to be applied to the ink ribbon 45, since the right-hand guide lever 98 is turned in the counterclockwise direction and the left-hand guide lever 98 is turned in the clockwise direction, the guide levers 98 act so as to weaken the tension applied to the ink ribbon 45. Therefore, the driving energy for the ratchet wheel 97 can be maintained at a very low level and the electromagnetic device can be of small size. Moreover, any slackening of the ink ribbon 45 caused by the abrupt reverse rotation of the reversing lever 112 and the resulting accelerated rewind-operation of the spool 93 in the opposite direction can be absorbed by the reverse rotation of the above guide levers 98. Therefore, undesired separation of the ink ribbon 45 from the printing position can be prevented.

In the foregoing ink ribbon transfer mechanism, the reversing lever 112 is supported on the shaft 96 on which ratchet wheel 97 is also mounted, whereby the assembling of the mechanism is remarkably facilitated. Furthermore, the reversing operation can easily be adjusted and is controlled by a simple arrangement in which the reversing ratchet 117 is adapted to be retracted from the path of the feed lever 120 by the spring 120.

It will thus be seen that the objects set forth above, among those made apparent from the preceding description, are efficiently attained and, since some changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein describged, and all statements of the scope of the invention, which, as a matter of language, might be said to fall therebetween.

What is claimed is:

1. In a flying printer, the improvement comprising a printing mechanism including a ratchet wheel continuously rotatable at a first speed and having at least one tooth, a print drum continuously rotatable at a second speed having a specific ratio to that of said ratchet wheel and having typeface characters arranged on the curved periphery thereof, at least one hammer means rotatable between a first position in which said characters on said print drum are imprinted and a second stand-by position, a trigger lever including an arm rotatably supported at a support point on each hammer means for driving the corresponding hammer means towards said print drum, each trigger lever being independently rotatable into and out of the path of said tooth of said ratchet wheel, means for selectively rotating each trigger lever into the path of said tooth of said ratchet wheel, said ratchet wheel tooth having a planar striking face for striking against said trigger lever and having an outermost point, designated by A, on a transverse section taken through the axis of said ratchet wheel, said trigger lever having a planar stroke-receiving face for receiving a stroke from said planar striking fact of said tooth and for making contact wherewith when said trigger lever is rotated into said path of said tooth, said planar striking face of said ratchet wheel tooth and said planar stroke-receiving fact of said trigger lever lying in a common contact plane at the moment of impact between said faces, said common contact plane passing through the center of rotation of said hammer means and the center of rotation of said ratchet wheel, said point A tracing a circle when rotated, a normal line being defined as the tangent to said circle at the point on said circle where said striking face makes contact with said stroke-receiving face, said support point being located on the side opposite to the axis of said ratchet wheel with respect to said normal line and an angle $\theta$ formed by said normal line and a line connecting said point A at contact with said stroke-receiving face and said support point lying in the range between 0° and 2.7° and buffer means including an elastic member having upper and lower two-stage members having shallow V-shaped grooves and deep V-shaped grooves formed alternately for receiving said arm of said hammer, said members being arranged so that one shallow V-shaped groove and one deep V-shaped groove are combined with each other in a vertical direction as a pair for receiving said hammer means at the stand-by position to absorb the force of the reaction of striking when said hammer means is returned to the stand-by position from the striking position.

2. A flying printer as set forth in claim 1, wherein said hammer means includes a hammer head and an arm having an end portion, said trigger lever being rotatably supported proximate said end portion of said arm.

3. A flying printer as set forth in claim 2, wherein an aperture is formed in said trigger lever, and a projection which is small relative to said aperture is formed on said end portion of said arm and extends through said aperture, the range of rotation of said trigger lever relative to said arm being defined by said projection and said aperture.

4. A flying printer as set forth in claim 2, wherein said trigger lever has a stroke-receiving portion including said stroke-receiving face, a first arm on the same side of said trigger lever as said stroke receiving portion and a second arm on the side of said trigger lever opposite to said first arm, the peripheral edge of said lever defined by said two arms being arcuate in shape.

5. A flying printer as set forth in claim 2, wherein said arm has a curved arm which is concave relating to said ratchet wheel and said ratchet wheel is disposed inside said curved portion of said arm of said hammer means.

6. A flying printer as set forth in claim 1, further including spring means for rotating said hammer means to said stand-by position and a guide member for restricting said rotation.

7. A flying printer as set forth in claim 1, wherein said buffer means includes a support member and a comb-shaped guide member for the hammer means, said elastic member and comb-shaped guide member being mounted on said support member, and said elastic member being plate-like in shape.

8. A flying printer as set forth in claim 1 wherein the elastic member is composed of a rubber.

9. The flying printer of claim 1 further including a paper transfer mechanism comprising a pair of wheels rotatably mounted on said rotation shaft of said print drum and having pins for engagement with transfer perforations in a paper, driving means for intermittently rotating said wheels, first guide means having two arcuate members for guiding said paper to said wheels, second guide means including one arcuate member having a notch for passage therethrough of said pins of said wheels, said second guide means serving for engaging said transfer perforations in said paper guide by said first guide means with said pins of said wheels to thereby guide said paper to a position of impacting by hammering means, and press means for pressing said paper guided by said second guide means against said wheels.

10. The flying printer as set forth in claim 9, wherein the diameter of said wheels is slightly larger than that of said print drum.

11. A paper transfer mechanism in a flying printer as set forth in claim 10, wherein a thrust washer composed of a material having a low coefficient of friction is mounted on the side wall of the wheel so that the wheel makes contact with the side wall of said print drum through said thrust washer.

12. A paper transfer mechanism in a flying printer as set forth in claim 11, wherein the circumferential face of the wheel is covered with a material having a high coefficient of friction.

13. A paper transfer mechanism in a flying printer as set forth in claim 9, wherein said first guide means has a regulating member for registering said transfer perforations of the paper with the pins of the wheels.

14. A paper transfer mechanism in a flying printer as set forth in claim 9, wherein said second guide means is rotatably pivoted so that the engagement between the notch and the pin may be temporarily set free.

15. A paper transfer mechanism in a flying printer as set forth in claim 9, wherein said press means is a leaf spring.

16. The flying printer of claim 1, including an ink ribbon transfer mechanism comprising a pair of spools on which an ink ribbon may be wound, a pair of ink ribbon transfer ratchet wheels each engaged with said spools, guide means for guiding the transferred ink ribbon, a pair of reverse operation levers each disposed for co-axial rotation with a corresponding ratchet wheel and each lever including a first operation-lever arm having means for detecting the time for reversing the transfer direction of said ink-ribbon and a second arm having a reversing ratchet rotatably supported thereon for reversing the direction of transfer of said ink ribbon, a feed lever having a first feed-lever arm for cooperating with said reversing ratchet and a second feed-lever arm including a pair of feed pawls for rotating said ratchet wheel, driving means for reciprocating said feed lever, and spring means for retracting said reversing ratchet outside the path of said first arm of said feed lever.

17. The flying printer as set forth in claim 16, wherein said ink ribbon guide means includes a pair of guide levers rotatably supported coaxially with said ratchet wheel for guiding ink ribbon between said spools and said reversing-time detecting means and a pair of spring means connected to said guide levers for imparting a restoring force thereto.

18. A flying printer as set forth in claim 1, and wherein said flying printer further comprises:

(a) a paper transfer mechanism, including a rotation shaft, a print drum mounted on said rotation shaft, a pair of wheels mounted on said rotation shaft and having pins for engagement with transfer perforations formed in a paper, driving means for intermittently rotating said wheels, first guide means having two arcuate members for guiding said paper to said wheels, second guide means including one arcuate member having a notch for passage therethrough of said pins of the wheels, said second guide means serving for engaging said transfer perforations in said paper guided by said first guide means with the pins of said wheels to thereby guide said paper to a position of impacting by said hammer means, and press means for pressing said paper guided by said second guide means against said wheels, and (b) an ink ribbon transfer mechanism including a pair of spools on which an ink ribbon is wound, a pair of ink ribbon transfer ratchet wheels each engaged with said spools, guide means for guiding the transferred ink ribbon, a pair of reverse operation levers each disposed for coaxial rotation with a corresponding ratchet wheel and each including a first operating lever arm having means for detecting the time for reversing the transfer direction of said ink ribbon and a second operating lever arm having a reversing ratchet rotatably supported thereon for reversing the direction of transfer of said ribbon, a feed lever having a first feed-lever arm for cooperating with said reversing ratchet and a second feed-lever arm including a pair of feed pawls for rotating said ratchet wheel, driving means for reciprocating said feed lever, and spring means for retracting said reversing ratchet outside the path of said first arm of said feed lever.

* * * * *